US012234997B2

(12) United States Patent
Morris et al.

(10) Patent No.: US 12,234,997 B2
(45) Date of Patent: Feb. 25, 2025

(54) COOKING APPLIANCE AND METHOD FOR IMAGE CAPTURE

(71) Applicant: Haier US Appliance Solutions, Inc., Wilmington, DE (US)

(72) Inventors: Sarah Virginia Morris, Louisville, KY (US); John Gilman Chapman, Jr., Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 262 days.

(21) Appl. No.: 17/840,702

(22) Filed: Jun. 15, 2022

(65) Prior Publication Data

US 2023/0408104 A1 Dec. 21, 2023

(51) Int. Cl.
*F24C 7/08* (2006.01)
*F24C 3/12* (2006.01)

(52) U.S. Cl.
CPC ..... *F24C 7/087* (2013.01); *F24C 3/128* (2013.01); *F24C 7/085* (2013.01)

(58) Field of Classification Search
CPC ..... F24C 7/0087; F24C 3/128; F24C 7/085
See application file for complete search history.

(56) References Cited

U.S. PATENT DOCUMENTS

| | | | | |
|---|---|---|---|---|
| 10,739,013 | B2 | 8/2020 | Bhogal | |
| 11,060,735 | B2 | 7/2021 | Bhogal et al. | |
| 11,187,417 | B2 | 11/2021 | Bhogal et al. | |
| 2017/0243617 | A1* | 8/2017 | Lee | G11B 27/031 |
| 2021/0228022 | A1* | 7/2021 | Liu | F24C 7/081 |
| 2021/0385917 | A1 | 12/2021 | Kuchler et al. | |

FOREIGN PATENT DOCUMENTS

| | | | |
|---|---|---|---|
| CN | 110234040 | A | 9/2019 |
| CN | 113194792 | A | 7/2021 |

* cited by examiner

*Primary Examiner* — Thien S Tran
(74) *Attorney, Agent, or Firm* — Dority & Manning, P.A.

(57) ABSTRACT

A cooking appliance and a method for operating a cooking appliance are provided. The cooking appliance includes a heating element configured to provide heat to a cooking chamber. The cooking chamber is configured to receive foodstuffs for cooking. An imaging device is configured with a field of view including at least a portion of the cooking chamber. A controller is in operable communication with the imaging device. The controller is configured to acquire, via the imaging device, an image at a rate of capture, the image corresponding to foodstuffs at the cooking chamber; determine, from the image, a doneness prediction corresponding to foodstuffs at the cooking chamber; and adjust the rate of capture based on comparing a rate of change of the foodstuffs to a change threshold.

20 Claims, 5 Drawing Sheets

600

| TIME (S) | 1 | 2 | 10 | 12 | 13 |
|---|---|---|---|---|---|
| PREDICTION | LOW 99%<br>MEDIUM 1% | LOW 99%<br>MEDIUM 1% | LOW 80%<br>MEDIUM 20% | LOW 70%<br>MEDIUM 30% | LOW 68%<br>MEDIUM 32% |
| ROC | | LOW - 0%<br>MEDIUM - 0% | LOW - -2.4%<br>MEDIUM - 2.4% | LOW - -5%<br>MEDIUM - 5% | LOW - -2%<br>MEDIUM - 2% |

FIG. 6

COOKING APPLIANCE AND METHOD FOR IMAGE CAPTURE

FIELD

The present disclosure generally pertains to cooking appliances and methods for controlling cooking appliances.

BACKGROUND

Apparatuses that include cameras may capture and store images that can be processed through computing algorithms to extract desired information. However, capturing and storing images in a computing device, such as a network or cloud computing environment, may be prohibitively expensive or computationally cumbersome. Such cost and computational limitations may further limit or prohibit implementing acquisition and control methods when cameras are applied to cooking apparatuses, such as ovens, air fryers, or cooktop appliances.

Cooking apparatuses generally include limited computing capacity and memory. Accordingly, methods and algorithms that generate large files for storage or transmission may be unusable for cooking apparatuses. Alternatively, methods and algorithms having insufficient data acquisition may be inhibited from being utilized for cooking apparatuses.

As such, there is a need for cooking apparatuses and methods for data acquisition and processing. Additionally, there is a need for cooking apparatuses and methods for operating cooking apparatuses, such as methods for cooking foodstuffs at cooking apparatuses.

BRIEF DESCRIPTION

Aspects and advantages of the invention will be set forth in part in the following description, or may be obvious from the description, or may be learned through practice of the invention.

An aspect of the present disclosure is directed to a cooking appliance. The cooking appliance includes a heating element configured to provide heat to a cooking chamber. The cooking chamber is configured to receive foodstuffs for cooking. An imaging device is configured with a field of view including at least a portion of the cooking chamber. A controller is in operable communication with the imaging device. The controller is configured to acquire, via the imaging device, an image at a rate of capture, the image corresponding to foodstuffs at the cooking chamber; determine, from the image, a doneness prediction corresponding to foodstuffs at the cooking chamber; and adjust the rate of capture based on comparing a rate of change of the foodstuffs to a change threshold.

Another aspect of the present disclosure is directed to a method for operating a cooking appliance and a method for capturing images. The method includes acquiring, via an imaging device with a field of view of foodstuffs at a cooking chamber, an image at a rate of capture, the image corresponding to foodstuffs at the cooking chamber; determining, from the image, a doneness prediction corresponding to foodstuffs at the cooking chamber; and adjusting the rate of capture based on comparing a rate of change of the foodstuffs to a change threshold.

Yet another aspect of the present disclosure is directed to a system for cooking foodstuff. The system includes a communication system including a network communicatively coupling to a remote server and a cooking appliance. The cooking appliance includes a heating element, an imaging device, and a controller. The heating element is configured to provide heat to a cooking chamber. The cooking chamber is configured to receive foodstuffs for cooking. The imaging device is configured with a field of view including at least a portion of the cooking chamber. The controller is in operable communication with the imaging device and the remote server. The controller is configured to acquire, via the imaging device, an image at a rate of capture, the image corresponding to foodstuffs at the cooking chamber; and transmit, via the network, the image and a parameter indicative of the rate of capture; The remote server is configured to determine, from the image received from the controller, a doneness prediction corresponding to foodstuffs at the cooking chamber; compare the rate of change received from the controller to the change threshold; determine an adjusted rate of capture based on comparing the rate of change to the change threshold; and transmit the adjusted rate of capture to the controller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 6 provides a table depicting an exemplary operation of the method in accordance with aspects of the present disclosure.

Figure 1:
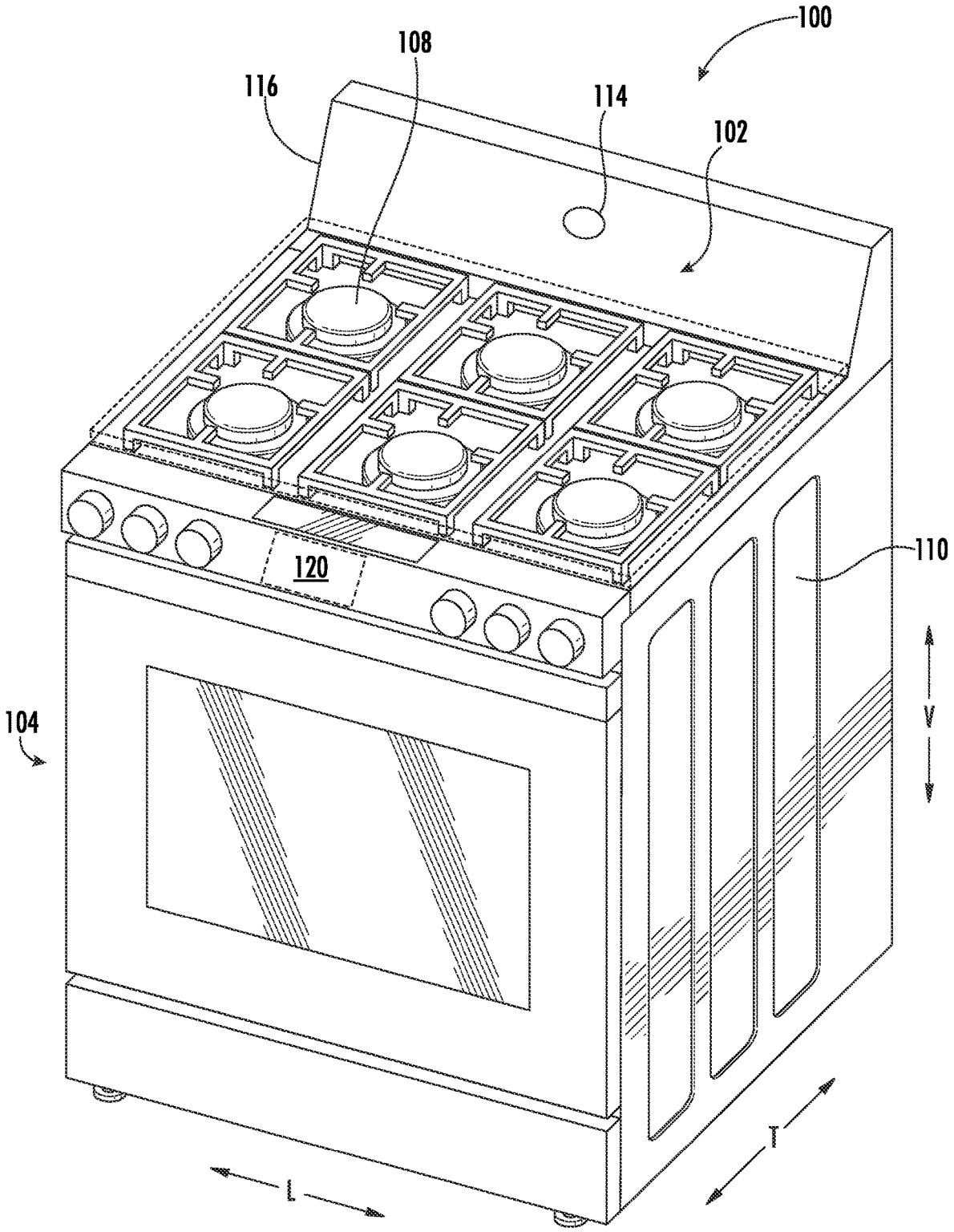
FIG. 1 provides a perspective view of an exemplary cooking appliance in accordance with aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Embodiments of a cooking appliance, a communication system, and a method for operating a cooking appliance are provided. Embodiments provided herein include an imaging device configured with a field of view including at least a portion of a cooking chamber at which foodstuffs are received for cooking. The imaging device is configured to acquire and generate images or corresponding data of a food parameter, such as a doneness level, of the foodstuffs at the cooking chamber. Embodiments of the method, such as when implemented at a cooking device, increase, decrease, and maintain a rate of capture at which the imaging device acquires images. The images or corresponding data are utilized by a computing device to determine the doneness level and alter the rate of capture. Accordingly, rather than acquiring images or corresponding data at a constant rate, embodiments of the method provided herein, such as when executed by a computing device, reduce an amount of data acquired or generated. The reduced data acquisition allows for artificial intelligence models to be utilized at cooking appliances or network computing devices, such as to determine cooking completion, or adjust cooking parameters (e.g., heat output to the cooking chamber, cook time, etc.).

Figure 2:
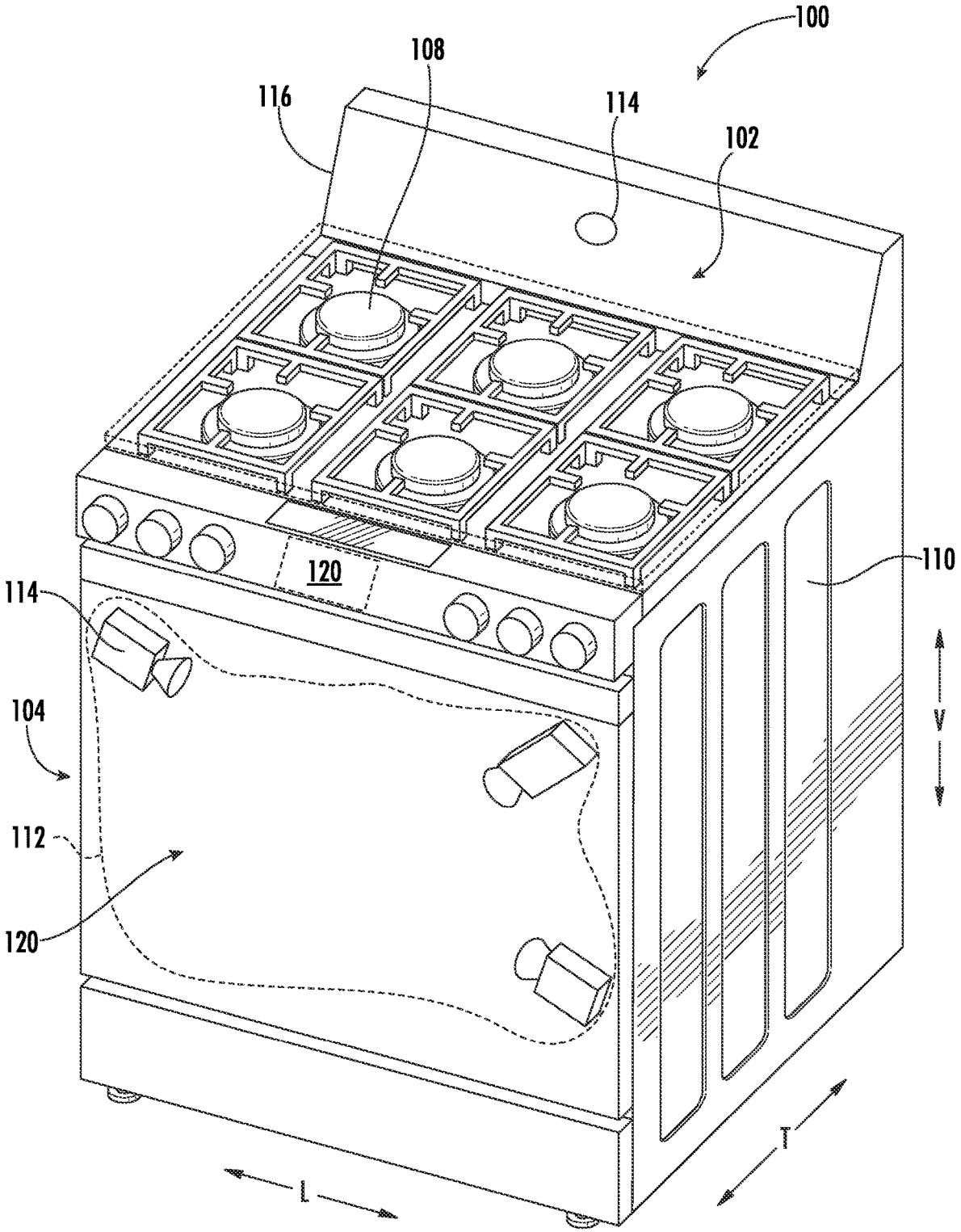
FIG. 2 provides a perspective view of the exemplary cooking appliance of FIG. 1 including portions of which are transparent to depict certain details in accordance with aspects of the present disclosure.

Referring now to the drawings, FIGS. 1-2 provide an exemplary embodiment of a cooking appliance 100 in accordance with aspects of the present disclosure. Cooking appliance 100 depicted in FIGS. 1-2 includes a cooktop appliance 102 and an oven appliance 104. Cooking appliance 100 includes one or more heating elements at the cooktop appliance 102 and the oven appliance 104. Various embodiments of the heating element are configured to release thermal energy or heat to cook foodstuffs positioned at a cooking chamber. Various embodiments of cooking chamber generally include an oven cooking chamber 106 at the oven appliance 104, or a cooking receptacle, such as pots, pans, etc., positioned at a cooktop heating element 108, such as an electric heating eye or gas burner at the cooktop appliance 102. Cooking appliance 100 generally includes walls or panels 110 at least partially forming the oven cooking chamber 106 of the oven appliance 104. Panels 110 may further form a structure at which cooktop appliance 102 is positioned atop. A door 112 is rotatably attached to panel 110 to allow access into oven appliance 104.

In various embodiments, cooking appliance 100 includes an imaging device 114 configured with a field of view including at least a portion of the cooking chamber. In particular, the imaging device 114 is configured to acquire images or data of foodstuffs at the cooking chamber. The imaging device includes any appropriate optical image configured to capture or acquire visual images or data substantially corresponding to a visual image. The imaging device 114 may capture images in visible light spectrum, infrared light, or other spectrums. As further provided herein, images or corresponding data from the imaging device 114 is acquired and provided to a computing device. In various embodiments, the imaging device 114 is positioned at or within the oven cooking chamber 106. Additionally, or alternatively, the imaging device 114 may be positioned outside of the oven cooking chamber 106. In still various embodiments, the imaging device 114 may be configured with a field of view including at least a portion of the oven cooking chamber 106. For instance, door 112 may include a transparent opening through which imaging device 114 may capture images of foodstuffs within the oven cooking chamber 106. In still various embodiments, imaging device 114 is positioned at a back panel 116. Imaging device 114 may be positioned at the back panel 116 to allow for a field of view into cooking receptacles positioned at the cooktop heating elements 108.

Although a particular embodiment of a cooking appliance 100 is provided, it should be appreciated that embodiments of the method and communication system further described herein may be applied or executed at standalone cooktop appliances, standalone oven appliances, air fryers, induction cooking devices, grills, open flames, fire pits, pressure cookers, or other cooking devices.

Figure 3:
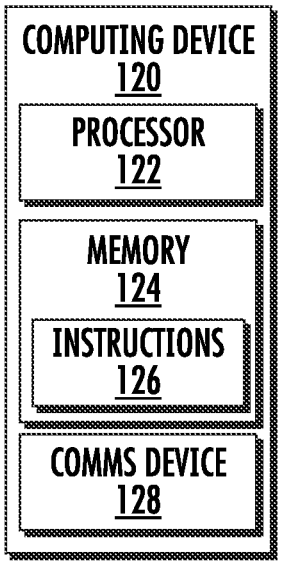
FIG. 3 provides a schematic embodiment of a computing device for a cooking appliance in accordance with aspects of the present disclosure.

Referring now to FIG. 3, a schematic embodiment of a computing device 120 is provided. The computing device 120 may include a processor 122, a memory device 124, and a communications device 128. The memory device 124 is configured to receive instructions 126 that, when executed by the processor 122, causes the cooking appliance 100 to perform operations. The communications device 128 provides a wired or wireless communications bus to send and/or receive signals, such as control signals or control commands as further described herein.

As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory device may generally include memory element(s) including, but not limited to, computer readable medium (e.g., random access memory (RAM)), computer readable non-volatile medium (e.g., flash memory), or other suitable memory elements or combinations thereof.

Figure 4:
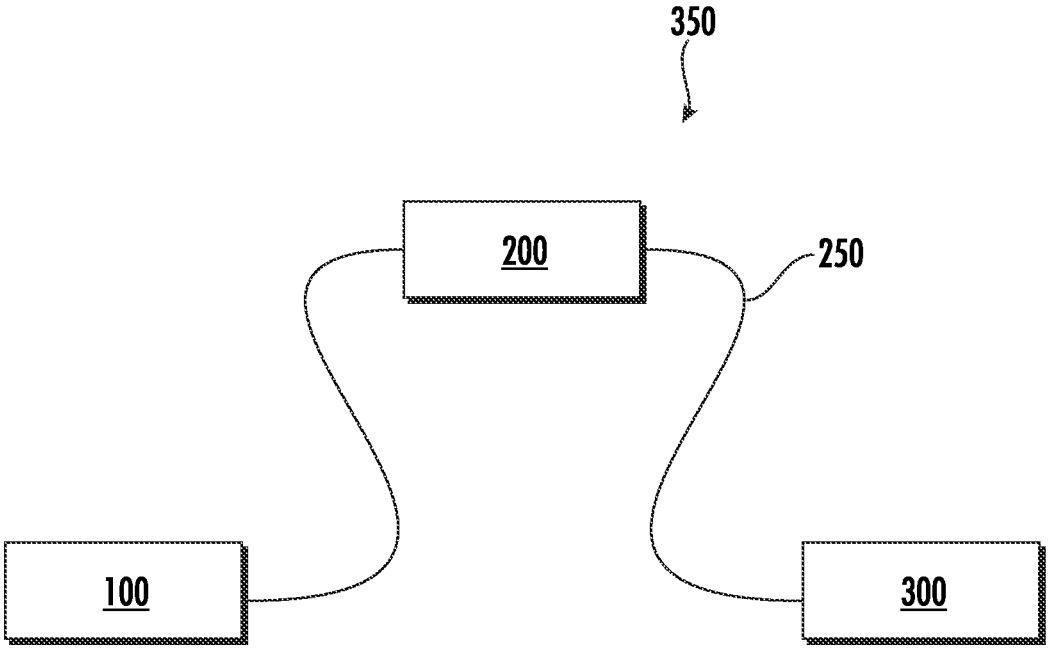
FIG. 4 provides a schematic embodiment of a communication system in accordance with aspects of the present disclosure.

Referring now to FIG. 4, a schematic diagram of a communication system 350 will be described according to an exemplary embodiment of the present subject matter. In general, communication system 350 is configured for permitting interaction, data transfer, and other communications between cooking appliance 100 and one or more external devices 300. For example, this communication may be used to transmit and receive images or corresponding data, control signals, control commands, user instructions or notifications, or any other suitable information for operating the cooking appliance 100 or cooking foodstuffs at a cooking appliance. In a particular embodiment, the external device 300 may command execution of one or more steps of a method for operating the cooking appliance 100.

For example, communication system 350 permits computing device 120 to communicate with a separate external device 300, i.e., external to cooking appliance 100. Such communications may be facilitated using a wired or wireless connection, such as via a network 250, e.g., a cloud computing system or distributed network of computing devices. In general, external device 300 may be any suitable device separate from cooking appliance 100 that is configured to transmit and/or receive communications, information, data, or commands. In this regard, external device 300 may be, for example, a personal phone, a smartphone, a tablet, a laptop or personal computer, a wearable device, a smart home system, or other remote computing device.

In addition, a remote server 200 may be in communication with cooking appliance 100 and/or external device 300 through the network 250. In this regard, for example, remote server 200 may be a cloud-based server, and is thus located at a distant location, such as in a separate building, city, state, country, etc., or generally elsewhere from the cooking appliance 100. According to an exemplary embodiment, external device 300 may communicate with the remote server 200 over network 250, such as the Internet, to transmit/receive data, information, images, control signals, control commands, or signals generally corresponding to one or more steps of a method for operating the cooking appliance such as provided herein. In addition, external device 300 and remote server 200 may communicate with cooking appliance 100 to communicate similar information.

In general, communication between cooking appliance 100, external device 300, remote server 200, and/or other user devices may be carried using any type of wired or wireless connection and using any suitable type of communication network, non-limiting examples of which are provided below. For example, external device 300 may be in direct or indirect communication with cooking appliance 100 through any suitable wired or wireless communication connections or interfaces, such as network 250. For example, network 250 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL). Particular portions of controller 120, such as the communications device 128, may be in operable communication with network 250, such as to receive or provide instructions, commands, etc. between external device 300 and memory device 124. External device 300 may accordingly command performance of steps of the method at cooking appliance 100.

Communication system 350 is described herein according to an exemplary embodiment of the present subject matter. However, it should be appreciated that the exemplary functions and configurations of communication system 350 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

As generally depicted at FIGS. 1-2, computing device 120, such as a controller configured generally for cooking appliances, is operably coupled to the cooking appliance 100, such as to transmit signals for operation of one or more components of the cooking appliance 100, e.g., heating elements and imaging devices. Computing device 120 at the cooking appliance 100 is further operably coupled to the imaging device 114 to receive images or corresponding data therefrom. Accordingly, in certain embodiments, computing device 120 is communicatively coupled to transmit and receive signals via network 250 to remote server 200 and external device 300.

Figure 5:
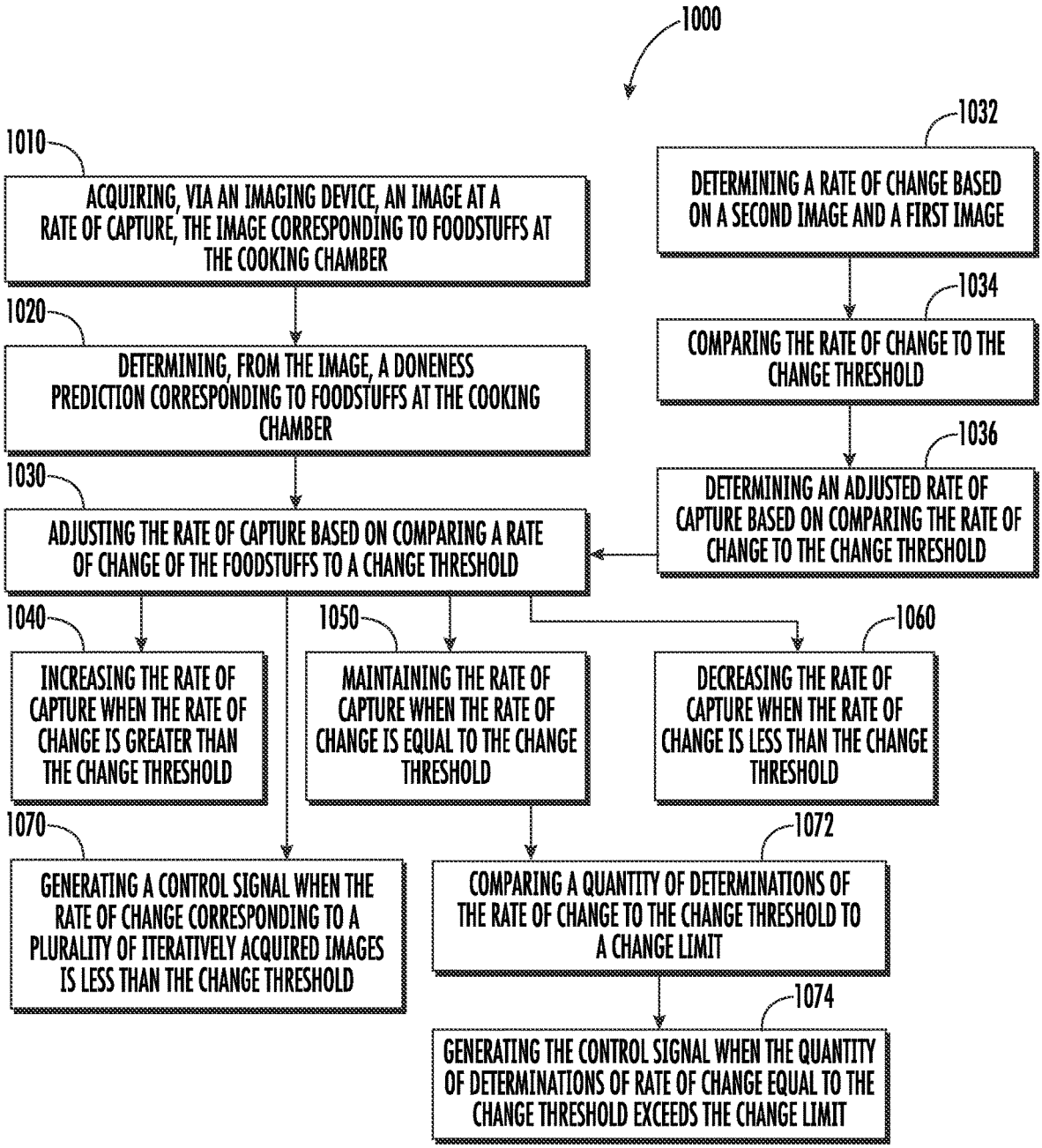
FIG. 5 provides a flowchart outlining steps of a method for operating a cooking appliance in accordance with aspects of the present disclosure.

Referring now to FIG. 5, a flowchart outlining exemplary steps of a method for operating a cooking appliance is provided (hereinafter, "method 1000"). Embodiments of method 1000 may additionally, or alternatively, provide steps of a method for cooking foodstuffs at a cooking appliance. Steps of method 1000 provided below may be stored and received at computing device 120, remote server 200, or external device 300, or transmitted between computing device 120, remote server 200, or external device 300, to execute steps at cooking appliance 100, remote server 200, or external device 300. Although steps of method 1000 may be provided in regard to cooking appliance 100 and/or communication system 350 such as depicted and described in regard to FIGS. 1-4, method 1000 may be implemented and executed at any appropriate cooking apparatus and computing device.

Referring to FIG. 5, method 1000 includes at 1010 acquiring, via an imaging device (e.g., imaging device 114), an image at a rate of capture, in which the image corresponds to foodstuffs at the cooking chamber. It should be appreciated that "image", as used herein, may generally include data corresponding to a visual, infrared, or other spectrum and foodstuffs. Foodstuffs may include any raw, uncooked, partially cooked, or other liquid, solid, or combination of food or other matter as may be provided to a cooking chamber (e.g., oven cooking chamber 106).

Method 1000 includes at 1020 determining, from the image, a doneness prediction corresponding to foodstuffs at the cooking chamber. Method 1000 includes at 1030 adjusting the rate of capture based on comparing a rate of change of the foodstuffs to a change threshold.

In various embodiments, method 1000 includes iteratively performing step 1010, 1020, or both. In particular embodiments, step 1030 is performed between iterative pairs of steps 1010 and 1020.

In certain embodiments, method 1000 includes at 1032 determining a rate of change based on a second image (e.g., current image) and a first image (e.g., previous image). In various embodiments, the computing device determines a doneness prediction from each image. In certain embodiments, the image is provided to a doneness model to determine the doneness prediction. The doneness model may include artificial intelligence algorithms, such as one or more appropriate machine learning algorithms or computer vision (CV) models, configured to determine whether a foodstuff is fully cooked, partially cooked, or uncooked, or various degrees thereof (e.g., 10% cooked, or 20% cooked, or 30% cooked, . . . or 80% cooked, or 90% cooked, etc.). The doneness model may compare the images to a learning model trained to correspond the images to fully cooked, partially cooked, or uncooked foodstuffs, or various degrees thereof. The doneness prediction may accordingly correspond to a determined probability of the acquired images corresponding to fully cooked, partially cooked, or uncooked foodstuffs, of various degrees thereof.

In particular, method 1000 at 1032 determines the rate of change based on a current doneness prediction corresponding to the second image (i.e., the current image) and a previous doneness prediction corresponding to the first image (i.e., the previous image). In a still particular embodiment, the previous image and corresponding previous doneness prediction is an immediately preceding image and corresponding doneness prediction. The rate of change is a function of a difference in the current doneness prediction and the previous doneness prediction over a change in time.

In particular embodiments, method 1000 includes at 1034 comparing the rate of change to the change threshold, and at 1036 determining an adjusted rate of capture based on comparing the rate of change to the change threshold. For instance, in certain embodiments, steps 1032, 1034, 1036 are performed between images acquired at 1010. Various embodiments of method 1000 may include adjusting the rate of capture based on a doneness model configured to generate a plurality of doneness predictions based on the plurality of images. The plurality of doneness predictions includes a current doneness prediction and a previous doneness prediction prior to the current doneness prediction.

Based on the rate of change, the rate of capture is increased, maintained, or decreased. In various embodiments, method 1000 includes at 1040 increasing the rate of capture when the rate of change is greater than the change threshold. In various embodiments, method 1000 includes at 1050 maintaining the rate of capture when the rate of change is equal to the change threshold. In still various embodiments, method 1000 includes at 1060 decreasing the rate of capture when the rate of change is less than the change threshold.

Referring to FIG. 6, an exemplary table 600 depicting an exemplary operation of the system and method is provided. A first image (e.g., corresponding to t=1) is acquired via the imaging device of foodstuffs at the cooking chamber (e.g., step 1010). The image is transmitted to a computing device, such as the controller, remote server, or external device. A second image (e.g., corresponding to t=2) is acquired via the imaging device and transmitted to the computing device.

As depicted in the exemplary table 600, the doneness prediction is unchanged relative to the first image at t=1 and the second image at t=2. Accordingly, the rate of change (ROC) is zero percent. The computing device performs step 1032 to compare the rate of change to a change threshold and step 1034 to determine an adjusted rate of capture based on step 1032. Referring table 600, the change threshold may be set at e.g., 2% ROC. Accordingly, the computing device performs step 1060 and decreases the rate of capture when the rate of change determined at step 1032 (e.g., 0%) is less than the change threshold (e.g., 2%). In the exemplary embodiment provided at FIG. 6, after acquiring the second image at t=2, the computing device decreases the rate of capture from one image per second to one image per eight (8) seconds.

Referring still to table 600, the computing device may iterate step 1010 and acquire a subsequent image at t=10 in accordance with the adjusted rate of capture. The computing device performs step 1020 to generate a doneness prediction based on a subsequent image acquired at t=10. The computing device furthermore determines, via step 1032, a rate of change based on the current image at t=10 and the previous image at t=2. The ROC is determined to be approximately 2.4%. The computing device compares, via step 1034, the determined ROC (i.e., approximately 2.4%) to the change threshold (e.g., 2%). In the exemplary embodiment provided at FIG. 6, after acquiring the third image at t=10, the computing device increases the rate of capture from one image per eight (8) seconds to one image per two (2) seconds.

Referring still to table 600, the computing device may iterate step 1010 and acquire a subsequent image at t=12 in accordance with the adjusted rate of capture. The computing device performs step 1020 to generate a doneness prediction based on a subsequent image acquired at t=12. The computing device furthermore determines, via step 1032, a rate of change based on the current image at t=12 and the previous image at t=10. The ROC is determined to be approximately 5%. The computing device compares, via step 1034, the determined ROC (i.e., approximately 5%) to the change threshold (e.g., 2%). In the exemplary embodiment provided at FIG. 6, after acquiring the forth image at t=12, the computing device increases the rate of capture from one image per two (2) seconds to one image per second.

A still subsequent image may be acquired at t=13. Method 1000 may perform steps such as provided herein to determine the ROC to be approximately 2%. In the exemplary embodiment provided at FIG. 6, after acquiring the fifth image at t=13, the computing device maintains the rate of capture at one image per second. Accordingly, the system executing steps of method 1000 acquires five (5) images from t=1 second to t=13 seconds at various rates of capture in contrast to acquiring thirteen (13) images from t=1 second to t=13 seconds at the initial rate of capture corresponding to t=1.

Embodiments of the system and method provided herein allow for dynamic adjustment of the rate of capture based on the acquired images and determined doneness predictions. Dynamic adjustment of the rate of capture allows for acquiring fewer images, allowing for decreased data acquisition, storage, and transmission. Decreased data acquisition, storage, or transmission may allow for imaging devices at cooking appliances to utilize and execute artificial intelligence algorithms for operation of the cooking appliance (e.g., cooking foodstuffs). Furthermore, decreased data acquisition, storage, or transmission may allow for executing artificial intelligence algorithms without necessitating larger or more complex computing devices having larger memory devices or processors. Still further, decreased data acquisition, storage, or transmission may allow for real-time determinations via cloud computing or a distributed network such as provided herein. Methods provided herein may allow for such determinations in contrast to larger datasets that may inhibit or prohibit timely transmission, determination, generation, or other execution of steps for determining doneness or foodstuff cooking completion.

In certain embodiments, method 1000 further includes at 1070 generating a control signal when the rate of change corresponding to a plurality of iteratively acquired images is less than the change threshold. The control signal may correspond to a user signal indicating completion of foodstuff cooking (e.g., a visual and/or audio message, alarm, or signal), or a control command decreasing or terminating energy or heat output from the heating element. Accordingly, the control signal may generally correspond to one or more signals indicative of ending foodstuff cooking.

In a particular embodiment, step 1070 is performed after iteratively performing steps 1010, 1020, and 1030 for a predetermined period of time or a predetermine quantity of iterations. In certain embodiments, method 1000 generates the control signal at 1070 after performing step 1060 to decrease the ROC. In still certain embodiments, method 1000 performs step 1070 after performing two or more of steps 1040, 1050, 1060. The control signal may be generated after a cycle has been performed including two or more of a decreased rate of capture, an increased rate of capture, and a maintained rate of capture. Accordingly, the control signal may be generated after foodstuffs have undergone a cycle of changes corresponding to the changes in rate of capture.

In a still particular embodiment, method 1000 includes at 1072 comparing a quantity of determinations of the rate of change equal to the change threshold to a change limit, and at 1074 generating the control signal when the quantity of determinations of rate of change equal to the change threshold exceeds the change limit. The change limit may include a predetermined limit corresponding to completion of foodstuff cooking. Accordingly, when the quantity of determinations is such that step 1050 (maintaining the rate of change) is repeated for a threshold quantity (i.e., the change limit), the predetermined quantity is indicative of completion of foodstuff cooking due to an unchanging rate of doneness predictions. Furthermore, the change limit may discontinue heat output from the heating element prior to an eventual subsequent change in doneness prediction that may correspond to overcooking or burning the foodstuffs. Still further, method 1000 may particularly perform step 1074 after performing step 1040 and step 1050.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance, comprising:

a heating element configured to provide heat to a cooking chamber, the cooking chamber configured to receive foodstuffs for cooking;

an imaging device configured with a field of view including at least a portion of the cooking chamber; and a controller in operable communication with the imaging device, the controller configured to:

acquire, via the imaging device, an image at a rate of capture, the image corresponding to foodstuffs at the cooking chamber;

determine, from the image, a doneness prediction corresponding to foodstuffs at the cooking chamber; and adjust the rate of capture based on comparing a rate of change of the foodstuffs to a change threshold.

2. The cooking appliance of claim 1, wherein the controller is configured to adjust the rate of capture based on a doneness model configured to generate a plurality of doneness predictions based on the plurality of images.

3. The cooking appliance of claim 2, wherein the plurality of doneness predictions comprises a current doneness prediction and a previous doneness prediction, and wherein the rate of change is a function of a difference in the current doneness prediction and the previous doneness prediction over a change in time.

4. The cooking appliance of claim 3, wherein the controller is configured to increase the rate of capture when the rate of change is greater than the change threshold.

5. The cooking appliance of claim 3, wherein the controller is configured to maintain the rate of capture when the rate of change is equal to the change threshold.

6. The cooking appliance of claim 3, wherein the controller is configured to decrease the rate of capture when the rate of change is less than the change threshold.

7. The cooking appliance of claim 1, wherein the controller is configured to iteratively acquire the image and determine the doneness prediction based on each image.

8. The cooking appliance of claim 7, wherein the controller is configured to generate a control signal when the rate of change corresponding to a plurality of iteratively acquired images is less than the change threshold.

9. The cooking appliance of claim 8, wherein the controller is configured to:

compare a quantity of determinations of the rate of change equal to the change threshold to a change limit; and generate the control signal when the quantity of determinations of rate of change equal to the change threshold exceeds the change limit.

10. The cooking appliance of claim 8, wherein the controller is configured to:

generate the control signal when the rate of change corresponding to the plurality of iteratively acquired images is less than the change threshold after the controller increased the rate of capture and after the controller maintained the rate of change.

11. The cooking appliance of claim 8, wherein the control signal corresponds to a user signal indicating completion of foodstuff cooking.

12. The cooking appliance of claim 8, wherein the control signal corresponds to a control command decreasing heat output from the heating element.

13. A system for cooking foodstuff, the system comprising:

a communication system comprising a network communicatively coupling to a remote server and a cooking appliance, the cooking appliance comprising a heating element, an imaging device, and a controller, wherein the heating element is configured to provide heat to a cooking chamber, the cooking chamber configured to receive foodstuffs for cooking, and wherein the imaging device is configured with a field of view including at least a portion of the cooking chamber, wherein the controller is in operable communication with the imaging device and the remote server, the controller configured to:

acquire, via the imaging device, an image at a rate of capture, the image corresponding to foodstuffs at the cooking chamber;

transmit, via the network, the image and a parameter indicative of the rate of capture; and wherein the remote server is configured to:

determine, from the image received from the controller, a doneness prediction corresponding to foodstuffs at the cooking chamber;

compare a rate of change received from the controller to the change threshold;

determine an adjusted rate of capture based on comparing the rate of change to the change threshold; and transmit the adjusted rate of capture to the controller.

14. The system of claim 13, wherein the controller is configured to adjust the rate of capture based on a doneness model configured to generate a plurality of doneness predictions based on the plurality of images.

15. The system of claim 14, wherein the plurality of doneness predictions comprises a current doneness prediction and a previous doneness prediction, and wherein the rate of change is a function of a difference in the current doneness prediction and the previous doneness prediction over a change in time.

16. The system of claim 15, wherein the controller is configured to increase the rate of capture when the rate of change is greater than the change threshold, and wherein the controller is configured to decrease the rate of capture when the rate of change is less than the change threshold.

17. The system of claim 13, wherein the controller is configured to iteratively acquire the image and determine the doneness prediction based on each image, and wherein the controller is configured to generate a control signal when the rate of change corresponding to a plurality of iteratively acquired images is less than the change threshold.

18. The system of claim 17, wherein the controller is configured to:

compare a quantity of determinations of the rate of change equal to the change threshold to a change limit; and generate the control signal when the quantity of determinations of rate of change equal to the change threshold exceeds the change limit.

19. The system of claim 17, wherein the controller is configured to:

generate the control signal when the rate of change corresponding to the plurality of iteratively acquired images is less than the change threshold after the controller increased the rate of capture and after the controller maintained the rate of change.

20. The system of claim 17, wherein the control signal corresponds to a user signal indicating completion of foodstuff cooking or a control command decreasing heat output from the heating element.

* * * * *